United States Patent [19]

Damsky

[11] 4,090,769

[45] May 23, 1978

[54] PLUG-IN ELECTRICAL RECEPTACLE EXTENDER

[76] Inventor: Arnold Damsky, 821 83rd St., Miami Beach, Fla. 33141

[21] Appl. No.: 798,771

[22] Filed: May 20, 1977

[51] Int. Cl.[2] ..... H01R 13/46; H01R 27/00

[52] U.S. Cl. ..... 339/156 R; 174/66; 339/166 R

[58] Field of Search ..... 339/153, 154, 156, 157, 339/159, 166, 123; 174/66

[56] References Cited

U.S. PATENT DOCUMENTS

| | | | |
|---|---|---|---|
| 3,131,013 | 4/1964 | Carlson | 339/159 R |
| 4,040,710 | 8/1977 | Damsky | 339/154 A |

FOREIGN PATENT DOCUMENTS

| | | | |
|---|---|---|---|
| 968,882 | 6/1975 | Canada | 174/66 |
| 1,058,680 | 11/1953 | France | 174/66 |

*Primary Examiner*—Neil Abrams
*Attorney, Agent, or Firm*—Ernest H. Schmidt

[57] ABSTRACT

A plug-in electrical receptacle extender for extending an existing receptacle to project through an opening in panelling, or the like cover material, used in renovating existing interior walls is used in association with an ordinary receptacle cover plate, thereby eliminating any need to relocate the existing receptacle. A cover plate extender is provided for use as a spacer under the outer cover plate in instances where the distance between the existing wall and renovating wall surfaces is small as compared with distances encountered when the outer wall covering material is applied over the spacer furring or the like, thereby simplifying installation while at the same time improving appearance.

4 Claims, 5 Drawing Figures

PLUG-IN ELECTRICAL RECEPTACLE EXTENDER

In my U.S. Pat. No. 4,040,710, issued Aug. 9, 1977, titled Plug-In Electrical Receptacle Extender, I describe such a device including a cover plate integrally formed with a rearwardly extending housing portion defining ordinary electric plug receptacle openings at the front and containing electrical receptacle contactor prongs extending rearwardly of the housing portion and adapted to plug into an existing receptacle to provide for electrical interconnection between the existing receptacle and the receptacle extension device. My present invention is directed to improvements in such plug-in electrical receptacle extenders.

In the remodeling of rooms by the installation of paneling, for example, or other materials of substantial thickness, particularly when furring strips are used between the wall surface and the paneling or other sheet material being used for remodeling, difficulties are often encountered in relocating existing electrical outlets in the added paneling. Heretofore, it has been common practice to remove the receptacle from its electrical connector box and attach it by means of wood screws or the like against marginal portions of an opening cut in a panel for this purpose, to be covered thereafter by a cover plate in the usual manner. If the original wiring in the connector box happened to be too short to permit the required extension of the receptacle, splicing became necessary, making the relocation even more difficult. More often than not such relocation of a receptacle is done by the carpenter installing the paneling instead of by a licensed electrician, resulting not infrequently in a faulty and hazardous condition. This is especially true when grounding of the receptacle to the metallic receptacle box is lost upon its removal and reassembly to the non-electrically conductive paneling.

It is, accordingly, the principal object of this invention to provide a novel and improved plug-in electrical receptacle extender for use in renovating wall paneling and the like that obviates the above-described difficulties and hazards in the relocation of properly installed existing receptacles.

A more particular object of the invention is to provide a plug-in electrical receptacle extender of the character described which will permit simple plug-in interconnection with the pre-existing electrical receptacle through a relatively small opening in the paneling being installed, and which, at the outside upon installation, simulates the appearance of an ordinary plug-in electrical receptacle with cover plate.

Another object of the invention is to provide a plug-in electrical receptacle extender of the above nature that comprises few and simple parts which can be provided in kit form for easy assembly by the user.

Other objects, features and advantages of the invention will be apparent from the following description when read with reference to the accompanying drawings. In the drawings, wherein like reference numerals donote corresponding parts throughout the several views.

Figure 1:
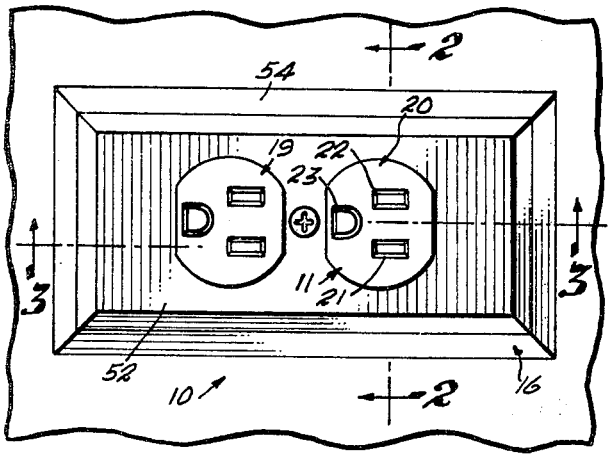
FIG. 1 is a front elevational view of a plug-in electrical receptacle extender embodying the invention as installed in a vertical wall.

Referring now in detail to the drawings, reference numeral 10 designates, generally, a preferred form of plug-in electrical receptacle extender, the same comprising a two-part housing member 11, two pairs of electrical contactor blades 12, **12*a* and 13, 13*a*, and a pair of ground contactor members 14, 15. The electrical receptacle extender further comprises a cover plate extender 16** which may be used in certain installations, as is hereinafter described.

The two-part housing member 11 comprises an outer housing piece or shell 17 and an inner housing piece or shell 18, both of which will preferably be injection molded of a tough synthetic plastic material. Although the electrical receptacle extender illustrated and described is for use in extending standard so-called "duplex" receptacles, it will be understood that the invention is adapted as well to use with single circuit receptacles.

Figure 3:
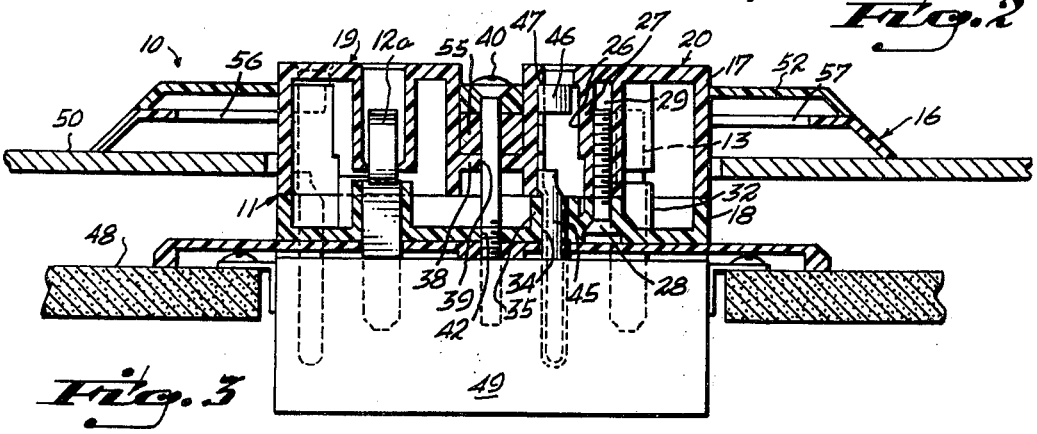
FIG. 3 is a transverse, cross-sectional view taken along the broken line indicated at 3—3 of FIG. 1 in the direction of the arrows.
Figure 5:
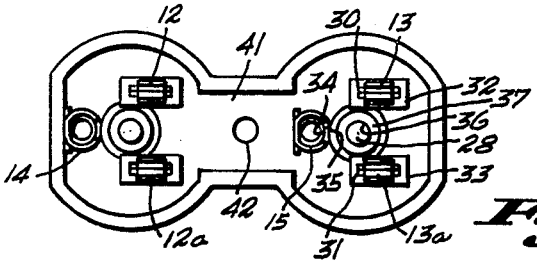
FIG. 5 is an inside plan view of the bottom housing shell of the receptacle extender shown with the electrical contact members fitted therein preparatory to its assemblage to the top housing shell.

As best illustrated in FIGS. 1, 3 and 5, the two-part housing member 11 is of "dumbbell" peripheral configuration providing a protrusion at each end, for individual plug connection. Since constructional details are substantially the same at each end of housing member 11 only the right side thereof, as illustrated in FIG. 1, will be described herein in detail.

The outer shell of the housing member 11 is formed with outwardly-extending twin shell portions 19, 20 of partially arcuate peripheral shape, adapted to project through conforming openings in a standard duplex receptacle cover plate or escutcheon 52. It is to be understood that the outwardly-extending twin shell portions 19, 20 illustrated in FIG. 1 have the same peripheral shape as the outwardly-projecting portions 58, 59 of the standard plug-in electrical receptacle 49 with which the plug-in electrical receptacle extender is to be used.

Figure 2:
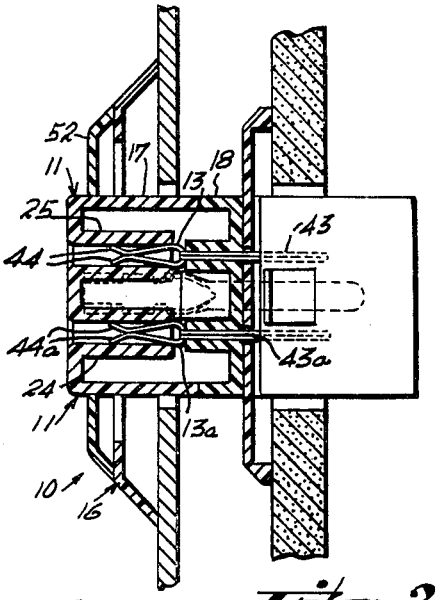
FIG. 2 is a vertical cross-sectional view taken along the line indicated at 2—2 of FIG. 1 in the direction of the arrows.

As illustrated in FIGS. 1, 2 and 3 the outer shell portion 20 is provided with a pair of spaced, parallel, rectangular through openings 21, 22 and a laterally offset, centrally located, D-shaped through opening 23. The parallel rectangular through openings 21, 22 are defined by inwardly projecting tubular wall portions 24, 25, respectively, which extends somewhat short of the inner end of the outer housing shell 17. The D-shaped through opening 23 extends into a substantially cylindrical opening 26 of somewhat greater size defined by an interior enclosing wall portion 27 which terminates in a plane common with the inner end or edge of the outer housing shell 17.

Figure 4:
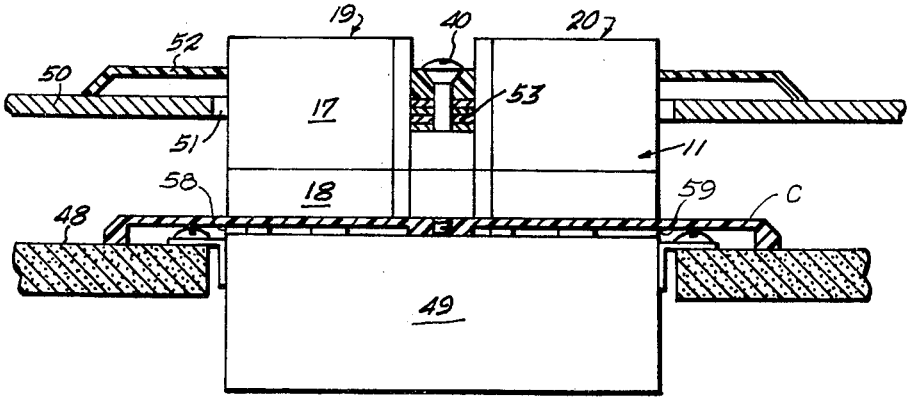
FIG. 4 is a view similar to that of FIG. 3 but without the use of the cover plate extender.

The inner housing shell 18 is complemental in peripheral shape to that of the outer housing shell 17, and is adapted to be assembled thereto by the use of self-tapping screws 28, (only one illustrated in FIG. 3), threadable in openings 29 provided in the underside of said outer housing shell. As best illustrated in FIGS. 2, 3 and 5, the inner housing shell 18 is also provided with parallel, rectangular through openings 30, 31 defined by inwardly-projecting tubular wall portions 32, 33 which extend somewhat beyond the peripheral edge at the inside of said inner housing shell. The inner housing shell 18 is also formed with a circular through opening 34 laterally offset and centrally located between the rectangular openings 30, 31, which circular opening is defined by an inwardly-projecting tubular wall portion 35 which terminates in a common plane with that of the inner peripheral edge of said inner housing shell. A central through opening 36 defined by inwardly projecting tubular wall 37 provides for the reception of self-tapping housing shells interconnecting screws 28. As illustrated in FIGS. 3 and 4 the central bridge portion 38 of the outer housing shell 17 is provided with a central through opening 39 for the reception of cover plate attachment screw 40, as is hereinafter more particularly described. The bridge portion 41 of the inner housing shell 18 is similarly provided with central opening 42 for through passage of cover plate attachment screw 40.

As best illustrated in FIGS. 2 and 3, the electrical circuit contactor blades **12, 12*a* and 13, 13*a* are fabricated of a doubled-together length of strip metal defining prong portions 43, 43*a* and mutually abuttingly stressed spring clip portion 44, 44*a* of decreased width but increased overall thickness. The ground contactor members are preferably of formed sheet metal defining a cylindrical prong portion 45 and diametrically enlarged C-spring portions 46**.

Assembly of the two-part housing member 11 with its contactors is easily accomplished by inserting respective prong portions through their openings 30, 31 and 34 from the inside of inner housing shell 18, whereupon the outer housing shell 17 can be fitted in place thereover, with the spring clip portions of the contactors fitted in the complimental through openings in said outer housing shell. As hereinabove mentioned, screws 28 will be utilized to secure the parts in inter-assembled relation. It will be noted that upon assembly, the increase in width at the juncture of the prong portions and spring portions of the circuit contactors **12, 12*a* and 13, 13*a* prevents their passage through to the outside of inner housing shell 18, whereas the decrease in width at the junctions prevents their withdrawal through the front of the receptacle extender such as might otherwise occur upon removal of a connector plug. Ground contactor members 14 and 15 will similarly be captured within the two-part housing member 11 upon assembly by virtue of the increase in size at the juncture of prong portion 45 with C-spring portion 46, and the shoulder 47 provided at the inner end of D-shaped through opening 23** against which the outer end of said C-spring abuts.

Referring now to FIG. 4 and considering a typical installation of a plug-in electrical connector assembly embodying the invention, reference numeral 48 designates the outer surface of a wall to be renovated by paneling, said wall having an existing duplex electrical receptacle 49. In accordance with the teachings of my invention, it is only necessary to remove the usual cover plate screw, (not illustrated), and temporarily secure the cover plate C in place, such as by use of masking tape, after which the paneling 50 will be nailed or otherwise secured to furring strips or the like (not illustrated). To install the plug-in electrical receptacle extender, it is only necessary to provide an opening 51 in the paneling, in alignment with a pre-existing electrical receptacle 49, this opening to be of sufficient size to permit passage of the two-part housing member assembly 11. Upon completion of the paneling, the plug-in electrical receptacle extender 10 will be plugged directly into the existing electrical receptacle 49, through the paneling opening 51, whereafter an ordinary duplex receptacle cover plate 52 can be applied over said plug-in receptacle and secured in place by the especially long cover plate attachment screw 40 received through openings 39 and 42 in the two-part housing member 11 and threadingly engaged in the threaded opening in the original duplex receptacle threaded opening 49 provided for cover plate attachment. A suitable number of spacers 53 will be placed on the cover plate attachment screw 40 behind the cover plate 52 to fill the gap between said cover plate and the central bridge portion 38 of the outer housing shell 17 to prevent undue stress upon said cover plate upon securing the attachment screw 40 in place.

As illustrated in FIG. 3, in instances where the spacing between the outer surface of the existing wall 48 to be renovated and the covering panel 50 is comparatively narrow, my invention contemplates the provision of an outer cover plate extender 16 for use in association with outer receptacle cover plate 52 to improve the appearance of the installation. Thus, as illustrated in FIGS. 1, 2 and 3, the comparatively large projection of the plug-in electrical receptacle extender 10, in such instances, is disguised by the use of the plate extender 16 in bringing the outer surface of associated outer cover plate 52 more nearly flush with the twin shell portions 19, 20.

As illustrated in FIGS. 1, 2 and 3, the plate extender 16 is integrally formed with a beveled peripheral edge 54, the upper end of which conforms with the peripheral shape of the underside of the ordinary outer cover plate 52, so that the beveled edge of said cover plate appears to be a complemental extension of said cover plate extender. The cover plate extender 16, as illustrated in FIG. 3, is integrally formed with a central transverse bridge portion 55 adapted to overlay the central bridge portion 38 of the outer housing shell 17, said transverse bridge portion being of the same height as the overall height of said cover plate extender and defining, at each side, large rectangular openings 56 and 57, through which the outwardly-extending twin shell portions 19 and 20 of the housing 11 can freely pass. It will be understood that the overall height of the assembled housing member 11, exclusive of its projecting contactors, will be such as to project somewhat through the opening provided in the renovating paneling or other outer wall surface, so as to be universally applicable to direct plug-in use with existing receptacles. As described above, in instances where the distance between the existing wall and the outer surface of the added paneling or the like is unusually small for one reason or another, the cover plate extender 16 will ordinarily be used, as illustrated in FIGS. 1, 2 and 3, to substantially improve the appearance of the installation.

While I have illustrated and described herein only one form in which my invention can conveniently be embodied in practice, it is to be understood that this embodiment is presented by way of example only, and not in a limiting sense. My invention, in brief, comprises all the embodiments and modifications coming within the scope and spirit of the following claims.

What I claim as new and desire to secure by Letters Patent is:

1. In a plug-in electrical receptacle extender for use in association with an existing electrical receptacle having an outwardly projecting electrically insulating housing, a plurality of contact prong receiving openings in the front surface of the housing, and a beveled edge cover plate of electrically insulating material having a through opening complemental in peripheral shape with the peripheral shape of the receptacle housing projection, the improvement comprising an electrically insulating housing member having separable inner and outer shell portions, said outer shell portion having an outwardly projecting portion providing, in the face thereof, a plurality of contact-prong-receiving openings having the same relative disposition as the contact prong openings in the original electrical receptacle, a plurality of electrical plug contactors behind said contact-prong-receiving openings in said outer shell and projecting inwardly of said inner shell portion thereof for plug-in reception in the original electrical receptacle, the peripheral shape of said outwardly-projection portion of said outer shell portion being the same as that of the original electrical receptacle to permit interfitting use therewith of an outer cover plate of the same size and shape as the original electrical receptacle cover plate, and a through opening in said housing member for the reception therethrough of a cover plate attachment screw for reception in the cover plate screw receiving opening in the original electrical receptacle for retaining said outer cover plate in covering relation with respect to the electrical receptacle extender.

2. The invention as defined in claim 1, wherein the existing electrical receptacle is a so-called "duplex" receptacle having a pair of laterally-spaced housing members, wherein said electrical receptacle extender comprises a like laterally-spaced pair of outwardly projecting portions, contact prong openings and electrical plug contactors, and wherein the peripheral shape of said outwardly projecting portions of said outer shell are substantially the same as that of the original "duplex" electrical receptacle to permit interfitting use of a cover plate of substantially the same size as a cover plate receivable over the existing "duplex" electrical receptacle.

3. The invention as defined in claim 2, and further including a cover plate extender having through openings for the passage of said outer shell projections and a transverse bridge portion receivable in the gap between said pair of outer shell projecting portions, said cover plate extender being adapted to be received beneath the outer cover plate upon the attachment thereof with respect to the existing electrical receptacle.

4. The invention as defined in claim 3, wherein said inner and outer housing shell portions are each integrally formed with locator means for receiving spring contact portions of said contactors in said outer shell portion and prong portions thereof in said inner shell portion, and means for removably securing said inner shell portion to said outer shell portion, whereby said electrical receptacle extender can be supplied in kit form for easy assembly.

* * * * *